US012251600B2

(12) United States Patent
Hicks

(10) Patent No.: US 12,251,600 B2
(45) Date of Patent: Mar. 18, 2025

(54) ADJUSTABLE, COMPACT GLUTE HAMSTRING DEVELOPER EXERCISE DEVICE

(71) Applicant: Christopher Hicks, Lincoln, NE (US)

(72) Inventor: Christopher Hicks, Lincoln, NE (US)

( * ) Notice: Subject to any disclaimer, the term of this patent is extended or adjusted under 35 U.S.C. 154(b) by 222 days.

(21) Appl. No.: 18/052,427

(22) Filed: Nov. 3, 2022

(65) Prior Publication Data

US 2024/0149110 A1 May 9, 2024

(51) Int. Cl.

| | |
|---|---|
| ***A63B 23/04*** | (2006.01) |
| ***A63B 21/00*** | (2006.01) |
| ***A63B 21/068*** | (2006.01) |
| ***A63B 23/035*** | (2006.01) |

(52) U.S. Cl.

CPC ..... *A63B 23/0494* (2013.01); *A63B 21/4013* (2015.10); *A63B 23/03525* (2013.01); *A63B 21/00047* (2013.01); *A63B 21/068* (2013.01); *A63B 21/4029* (2015.10); *A63B 2225/09* (2013.01)

(58) Field of Classification Search

CPC ..... A63B 21/068; A63B 21/4013; A63B 21/00047; A63B 21/4029; A63B 23/03525; A63B 23/0494; A63B 23/02; A63B 23/0205; A63B 23/0211; A63B 2225/09

See application file for complete search history.

(56) References Cited

U.S. PATENT DOCUMENTS

| | | | | |
|---|---|---|---|---|
| 6,231,487 | B1 | 5/2001 | Diamond, Jr. et al. | |
| 6,468,188 | B1 | 10/2002 | Koenig | |
| 7,322,911 | B2 * | 1/2008 | Webber | A63B 23/0211 482/142 |
| 7,442,153 | B1 | 10/2008 | Chasnov | |
| 7,678,033 | B2 * | 3/2010 | Tyree | A63B 21/4035 482/142 |
| 7,794,375 | B1 | 9/2010 | Jackson, Jr. et al. | |
| 8,007,414 | B2 | 8/2011 | Riney et al. | |
| 8,172,736 | B2 | 5/2012 | Contreras | |
| 9,630,055 | B2 | 4/2017 | Runyan | |
| 9,669,255 | B2 | 6/2017 | Henniger | |
| 9,717,942 | B2 * | 8/2017 | Bastyr | A63B 23/0355 |
| 9,878,203 | B1 * | 1/2018 | Guarnaccia | A63B 21/00047 |
| 9,968,825 | B2 * | 5/2018 | Snyder | A63B 21/4047 |
| 10,420,974 | B2 | 9/2019 | Henninger | |
| 10,426,999 | B2 | 10/2019 | Doherty | |
| 10,737,134 | B2 | 8/2020 | Anderson et al. | |
| 10,974,096 | B2 | 4/2021 | Simmons | |

(Continued)

*Primary Examiner* — Megan Anderson
(74) *Attorney, Agent, or Firm* — Dunlap Bennett & Ludwig, PLLC

(57) ABSTRACT

An exercise device for glute hamstring exercises is herein disclosed. The exercise device includes a support base and a retractable pad assembly. The support based includes a knee pad supported by two side rails, with the knee pad and two side rails defining a recessed portion. The retractable pad assembly includes a lower bar designed to engage a floor or other surface. The support bar is pivotally coupled to the lower bar. A fitness pad is coupled to the support bar. The retractable pad assembly is slidably coupled to the support base between: (1) a collapsed position wherein the lower bar and the support bar are disposed in the recessed portion and (2) an extended position wherein the lower bar and the support bar extend out of the recessed portion.

10 Claims, 3 Drawing Sheets

(56) References Cited

U.S. PATENT DOCUMENTS

| | | | | |
|---|---|---|---|---|
| 11,130,018 | B2 | 9/2021 | Kordecki | |
| 11,358,023 | B1 * | 6/2022 | Chin | A63B 21/4031 |
| 11,904,198 | B1 * | 2/2024 | Romano | A63B 21/4035 |
| 2014/0194260 | A1 | 7/2014 | Campanaro et al. | |
| 2018/0214739 | A1 | 8/2018 | Anderson | |
| 2022/0118308 | A1 * | 4/2022 | Park | A63B 21/00047 |

* cited by examiner

ADJUSTABLE, COMPACT GLUTE HAMSTRING DEVELOPER EXERCISE DEVICE

BACKGROUND OF THE INVENTION

The present invention relates to exercise devices and, more particularly, to an adjustable glute hamstring developer that reduces space and makes exercise scalable to users' fitness levels.

Traditional glute ham and/or Nordic curl machines take up a large amount of space and the exercise itself is difficult for most people to perform unassisted. There are many issues with conventional devices. For example, existing Nordic curl and glute ham machines are not scalable for the user, take up significant space, and are not easily moveable (i.e., are heavy and/or stationary). Most users do not have the strength and muscle control to perform Nordic curls without assistance. Nordic hamstring curls are very difficult for the average use to complete without using multiple pads and/or bands to assist in performing the exercise.

As can be seen, there is a need for an exercise device as described herein.

SUMMARY OF THE INVENTION

In one aspect of the present invention, an exercise device is disclosed that includes: a support base comprising a knee pad supported by two side rails, the knee pad and two side rails defining a recessed portion; and a retractable pad assembly comprising a lower bar configured to engage a floor or other surface, a support bar pivotally coupled to the lower bar, and a fitness pad coupled to the support bar, the retractable pad assembly being slidably coupled to the support base between: a collapsed position wherein the lower bar and the support bar are disposed in the recessed portion; and an extended position wherein the lower bar and the support bar extend out of the recessed portion.

These and other features, aspects and advantages of the present invention will become better understood with reference to the following drawings, description, and claims.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

DETAILED DESCRIPTION OF THE INVENTION

Figure 1:
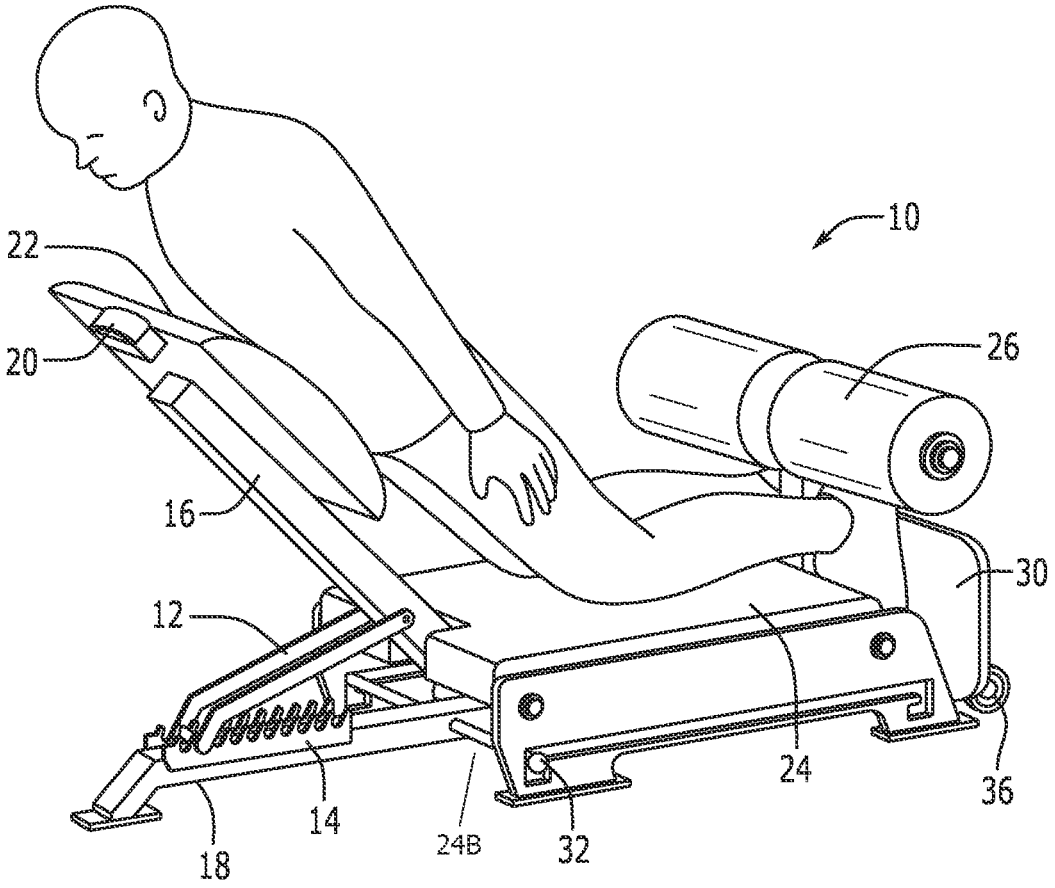
FIG. 1 is a side perspective view of the adjustable glute hamstring developer invention.
Figure 2:
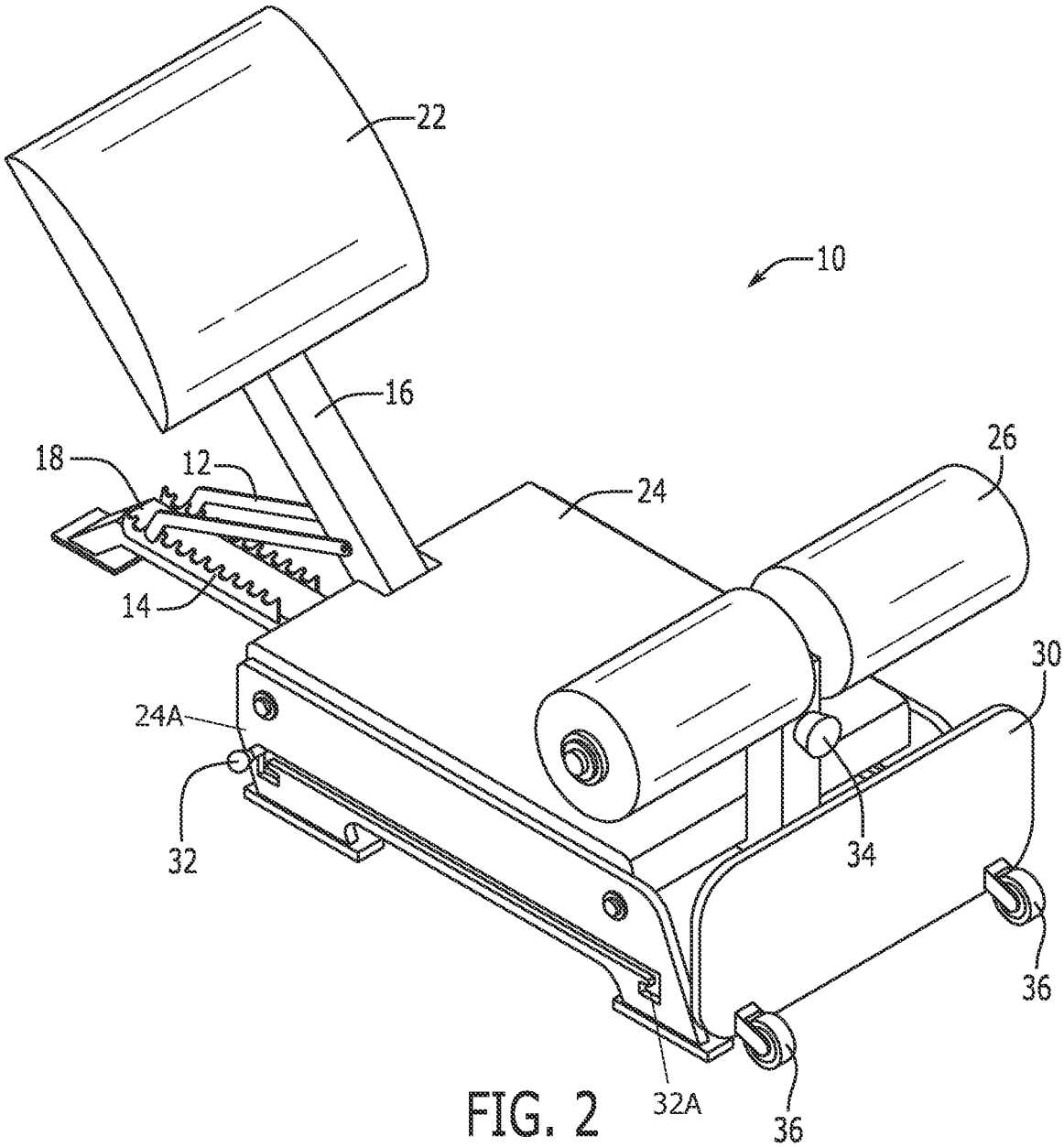
FIG. 2 is a top perspective view of the invention.

The subject disclosure is described with reference to the drawings, wherein like reference numerals are used to refer to like elements throughout. In the following description, for purposes of explanation, numerous specific details are set forth in order to provide a thorough understanding of the present disclosure such that one skilled in the art will be enabled to make and use the present invention. It may be evident, however, that the present disclosure may be practiced without some of these specific details. For the purpose of clarity, technical material that is known in the technical fields related to the present invention has not been described in detail so that the present invention is not unnecessarily obscured In accordance with certain aspects of the present invention, an adjustable glute ham developer is provided that includes a retractable pad that slides under the main body to reduce the space it takes up. The pad that slides out has an adjustable lever on the underside that lets the user raise that pad to an angle that suits their fitness level for performing Nordic hamstring curls. The higher the pad is elevated, the easier the exercise is to perform.

Prior to the present invention, there were no other machines that allow the user to perform Nordic curls without using props and bands fixed from other devices to assist in performing the exercise. This invention reduces the space a traditional Nordic curl/glute ham machine takes up and creates ease if needing to be moved. The present invention allows a user to perform Nordic curls to their fitness level without the aid of prop pads and bands.

Referring now to FIGS. 1, a glute hamstring developer exercise device 10 is shown. A support base of the exercise device 10 includes a knee pad 24 (where a user's knees rest, in use) supported by two side rails 24A on opposing lateral sides thereof. The side rails 24A each define an elongated C-shaped slot 32A in which a storage adjustment pin 32 slidably rides, in use (explained in greater detail below). The terminal ends of the slot 32A have bends/notches (forming the C-shape) that allow the pin 32 to be locked into place at those terminal ends. As shown in FIG. 1, a recessed portion 24B is present underneath the knee pad 24 and between the side rails 24A.

On a first side of the support base is a foot plate 30 with two wheels 36 rotatably mounted thereon. The foot plate 30 is configured to support a user's feet while performing a Nordic curl. The wheels 36 are used to easily move the exercise device 10 around as needed. A post 25 that supports padded ankle supports 26 also extends upwardly from this side. A height of the ankle supports 26 is adjustable utilizing an ankle pad adjustment pin 34. The ankle supports 26 function in unison with the foot plate 30 to maintain the user's feet in place while using the exercise device 10.

On a second side of the support base, opposite the first side, is a retractable pad assembly. The retractable pad assembly includes a retractable lower bar 18, an adjustable support bar 16 pivotally coupled to the lower bar 18, a fitness pad 22 coupled at an upper end of the support bar 16, an adjusting mechanism 12, and adjusting notches 14. The fitness pad 22 is where a user's chest is supported when performing a Nordic curl. The adjusting mechanism 12 can be adjusted via movement of the support bar 16 to engage selective notches of the adjusting notches 14 which adjusts the angle of the support bar 16 relative to the knee pad 24. The angle of adjustment, in certain embodiments, may be from 0 to 60 degrees. As shown in FIG. 1, the adjustment pin 32 extends from one side rail 24A, through the lower bar 18 to form a coupling therewith, to the other side rail 24A.

Figure 3:
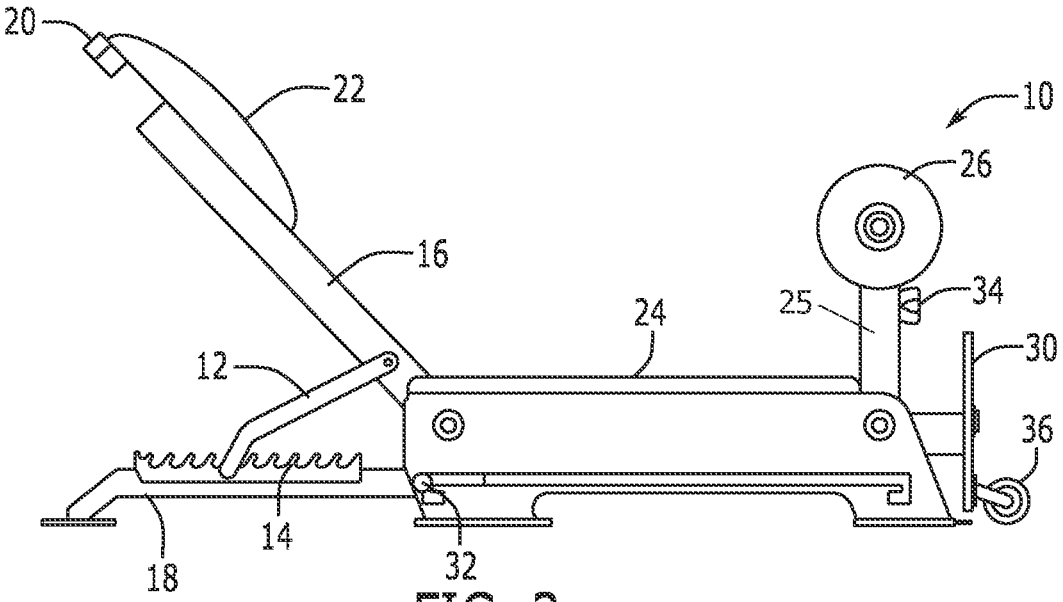
FIG. 3 is a first side elevation view of the invention in a fully extended mode.
Figure 4:
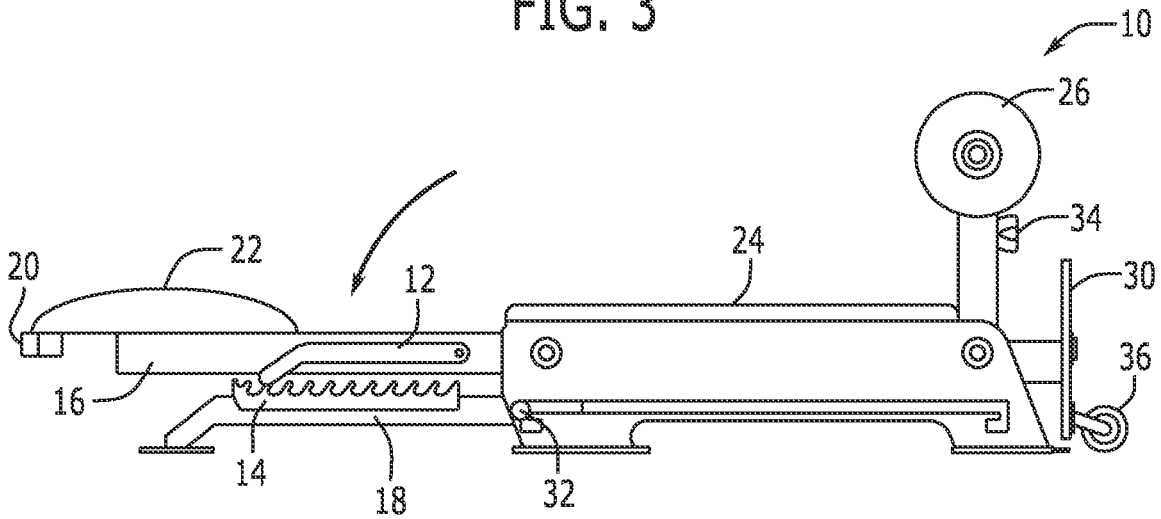
FIG. 4 is a second side elevation view of the invention in a partially extended mode.
Figure 5:
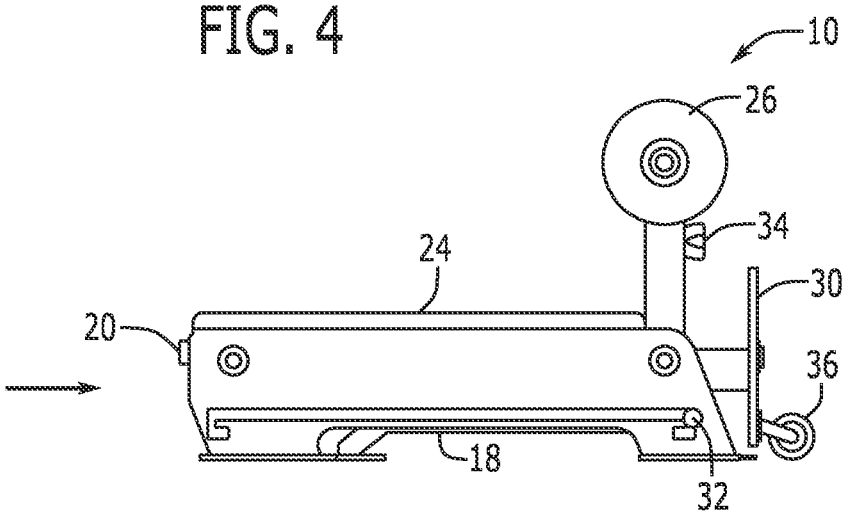
FIG. 5 is a third side elevation view of the invention in a fully contracted mode.

As seen in FIGS. 1-5, the fitness pad 22 includes a handle 20 which is operable by a user to manipulate the support bar 16 and the lower bar 18, as exemplified in FIGS. 3-5 and described in greater detail below. Specifically, the handle can be used to pivot the support bar 16 upwards to various inclined positions, downwards to a collapsed position, and slide the entire retractable pad assembly into and out of the support base.

An exemplary use case may be as follows, with directional references being made relative to the position of the exercise device 10 shown in FIGS. 3-5. The assembly 10 may first be provided in a collapsed position, as shown in FIG. 5, with the engagement pin 32 engaging the right side notch of the slot 32A. The user can operate the pin 32 out of engagement with the notch to unlock the retractable pad assembly. Pulling the handle 20 to the left pulls out the retractable pad assembly out of the recessed portion 24B of the support base to the position shown in FIG. 4. At that point, the engagement pin 32 can be moved to engage in the left side notch of the slot 32A to lock the retractable pad assembly in the expanded position. The user can then use the handle to lift the support bar to a desired angle, with the adjusting mechanism 12 providing incremental angular adjustments. The user may position themselves on the exercise device as shown in FIG. 1.

Once the exercise has been completed, the user can lift up on the handle 20 to release the adjusting mechanism from the adjusting notches 14 and lower the support bar 16 back down until it is parallel with the lower bar 18. Similar to the steps taken to pulling the retractable pad assembly out, the engagement pin 32 can be unlocked from the left side notch in the slot 32A, the handle pushed rightwards to slide the retractable pad assembly underneath the knee pad 24 (and directly between the side rails 24A in the recessed portion 24B), with only the handle 20 extending out from underneath the support base. Thus, even the fitness pad 22 is stowed away underneath the knee pad 24 in the collapsed position. Finally, the engagement pin 32 can be locked again with the right side notch, enabling the exercise device to be easily transported and/or stowed away.

As will be appreciated by those with skill in the art, the components and arrangement thereof of the present invention allow this device 10 to adjust the difficulty level in performing Nordic Hamstring Curls, making this exercise more accessible for the average person by allowing them to scale the exercise to their desired difficulty level. The retracting slider aspect allows it to be much more compact than traditional glute ham/Nordic machines.

The average user of the present invention would be able to perform Nordic hamstring curls they would normally not be able to perform without props, bands, or additional equipment to make the exercise easier. By having an adjustable arm and pad for their chest to come in contact with, they are able to control the difficulty level to their ability.

While one or more preferred embodiments are disclosed, many other implementations will occur to one of ordinary skill in the art and are all within the scope of the invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. Other arrangements, methods, modifications, and substitutions by one of ordinary skill in the art are therefore also considered to be within the scope of the present invention, which is not to be limited except by the claims that follow.

While apparatuses and methods are described in terms of "comprising," "containing," or "including" various components or steps, the apparatuses and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. Also, the terms in the claims have their plain, ordinary meaning unless otherwise explicitly and clearly defined by the patentee. The term "substantially" shall be interpreted to mean completely and/or nearly completely. Moreover, the indefinite articles "a" or "an," as used in the claims, are defined herein to mean one or more than one of the elements that it introduces. If there is any conflict in the usage of a word or term in this specification and one or more patent or other documents that may be incorporated herein by reference, the definitions that are consistent with this specification should be adopted. Moreover, the use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

What is claimed is:

1. An exercise device comprising:

a support base comprising a knee pad supported by two side rails, the knee pad and the two side rails defining a recessed portion; and a retractable pad assembly comprising a lower bar configured to engage a floor or other surface, a support bar pivotally coupled to the lower bar, and a fitness pad coupled to the support bar, the retractable pad assembly being slidably coupled to the support base between:

a collapsed position wherein the lower bar and the support bar are disposed in the recessed portion; and an extended position wherein the lower bar and the support bar extend out of the recessed portion.

2. The exercise device of claim 1, wherein each side rail of the two side rails defines a slot along a length thereof.

3. The exercise device of claim 2, further comprising an adjustment pin coupled to the lower bar and slidable within the slot of each side rail both of the slots.

4. The exercise device of claim 3, wherein each of the slots is C-shaped.

5. The exercise device of claim 3, wherein each of the slots has terminal ends that the adjustment pin is configured to lockably engage.

6. The exercise device of claim 1, wherein, in the collapsed position, the fitness pad is disposed in the recessed portion beneath the knee pad.

7. The exercise device of claim 6, wherein the fitness pad is configured to support a user's chest of a user.

8. The exercise device of claim 6, further comprising a handle coupled to the fitness pad that, in the collapsed position, is not disposed in the recess portion.

9. The exercise device of claim 1, further comprising a foot pad configured to support a user's feet of a user.

10. The exercise device of claim 9, further comprising an ankle pad configured to support a user's ankles of the user.

* * * * *